US009295891B1

(12) United States Patent
Higgins

(10) Patent No.: US 9,295,891 B1
(45) Date of Patent: Mar. 29, 2016

(54) PRACTICE SYSTEM FOR MARTIAL ARTS AND SIMILAR DISCIPLINES

(71) Applicant: Matthew Higgins, Buffalo, MN (US)

(72) Inventor: Matthew Higgins, Buffalo, MN (US)

( * ) Notice: Subject to any disclaimer, the term of this patent is extended or adjusted under 35 U.S.C. 154(b) by 134 days.

(21) Appl. No.: 13/967,297

(22) Filed: Aug. 14, 2013

Related U.S. Application Data

(60) Provisional application No. 61/683,072, filed on Aug. 14, 2012.

(51) Int. Cl.
*A63B 21/00* (2006.01)
*A63B 69/00* (2006.01)

(52) U.S. Cl.
CPC ..... *A63B 69/004* (2013.01)

(58) Field of Classification Search
USPC ..... 482/83–90, 121, 97, 100
See application file for complete search history.

(56) References Cited

U.S. PATENT DOCUMENTS

| | | | | | |
|---|---|---|---|---|---|
| 4,309,029 | A | | 1/1982 | Tomko | |
| 4,546,966 | A | | 10/1985 | Segura | |
| 4,645,197 | A | * | 2/1987 | McFee | 482/31 |
| 4,662,630 | A | | 5/1987 | Dignard et al. | |
| 4,749,184 | A | | 6/1988 | Tobin | |
| 4,913,419 | A | | 4/1990 | McAuliffe | |
| 5,183,451 | A | | 2/1993 | Hautamaki | |
| 5,232,368 | A | * | 8/1993 | Morgia | 434/247 |
| 5,458,552 | A | | 10/1995 | Mara | |
| 5,464,377 | A | | 11/1995 | Beeman | |
| 5,735,775 | A | | 4/1998 | Miasserian | |
| 6,077,204 | A | | 6/2000 | Dickinson, Jr. | |
| 6,149,554 | A | * | 11/2000 | Ferguson | 482/83 |
| 6,736,764 | B1 | | 5/2004 | Kapustka | |
| 2006/0247106 | A1 | | 11/2006 | Peavey | |
| 2007/0197349 | A1 | | 8/2007 | Gonzalez | |
| 2007/0249473 | A1 | * | 10/2007 | Robinson | 482/83 |
| 2009/0264262 | A1 | | 10/2009 | Brenner et al. | |
| 2010/0130329 | A1 | | 5/2010 | Sullivan et al. | |

OTHER PUBLICATIONS

"Spin Kick Martial Arts Kick Trainer"—at blackbeltshop.com: http://www.blackbeltshop.com/spin_kick.htm See NPL submitted herewith. Copyright information on bottom of page indicates year 1999-2014. "Wayback machine" shows product listed on Apr. 1, 2004.

* cited by examiner

*Primary Examiner* — Jerome W Donnelly
(74) *Attorney, Agent, or Firm* — Underwood & Associates, LLC

(57) ABSTRACT

A system for practicing striking is described. The system includes a base support member, a support arm hingedly connected to said base support member capable of swinging from a first, at-rest position, to a second, post-strike position, a striking surface attached to an end of said support arm, and a return mechanism configured to resiliently return said support arm from said post-strike position to said at-rest position after the striking surface has been struck. The striking surface comprises one or more walls capable of providing tactile feedback to a practitioner for practicing a striking technique.

16 Claims, 12 Drawing Sheets

142 z
x
y
100
150
h
145
151
102
140a
115a
105
110
120
124
125b
135b
130
125a
135a
103
102
101
104

100

PRACTICE SYSTEM FOR MARTIAL ARTS AND SIMILAR DISCIPLINES

CROSS-REFERENCE TO RELATED APPLICATIONS

This application claims priority under 35 U.S.C. §119(e) of U.S. Provisional Patent Application No. 61/683,072, filed Aug. 14, 2012, which is incorporated herein by reference in its entirety for all purposes.

TECHNICAL FIELD

This disclosure relates to striking systems that can be used in the practice of various forms of martial arts, boxing, and similar arts.

BACKGROUND

Sparring can be an integral component of a self-defense or sport-fighting curriculum. Especially prevalent in boxing and the martial arts, participants can hone their skills by practice-fighting with partners, where pads are usually worn that protect them from substantially injuring one another as they engage in competitive sparring.

A number of devices have been developed that allow martial artists, boxers, and practitioners of similar sports to practice without a partner. Recognizable among skilled artisans are padded products such as punching bags, so-called "heavy bags," "Thai pads," and "focus-mitts" that allow the practitioner to repeatedly strike a padded target.

Some of these products provide a substantially flat striking surface and a padded interior to reduce the likelihood of injury to both the practitioner and a partner who can hold the pads in selected positions. In the absence of a partner, however, the practitioner is left to strike static targets such as heavy bags which tend to swing freely and somewhat unpredictably from a resting position after being struck. Other martial arts and boxing products such as speed bags are used to improve strength and hand-eye coordination.

SUMMARY

In one exemplary aspect, a system for practicing striking is described. The system includes a base support member and a support arm hingedly connected to the base support member capable of swinging from a first, at-rest position, to a second, post-strike position. The system further includes a striking surface attached to an end of the support arm and a return mechanism configured to resiliently return the support arm from the post-strike position to the at-rest position after the striking surface has been struck. The striking surface includes one or more walls capable of providing tactile feedback to a practitioner for practicing a striking technique.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings in which like references indicate similar elements, and in which:

FIG. 1G is a side elevational view thereof showing the system in a first, resting position and a second, pivot-shifted position;

DETAILED DESCRIPTION OF ILLUSTRATIVE EMBODIMENTS

Figure 1A:
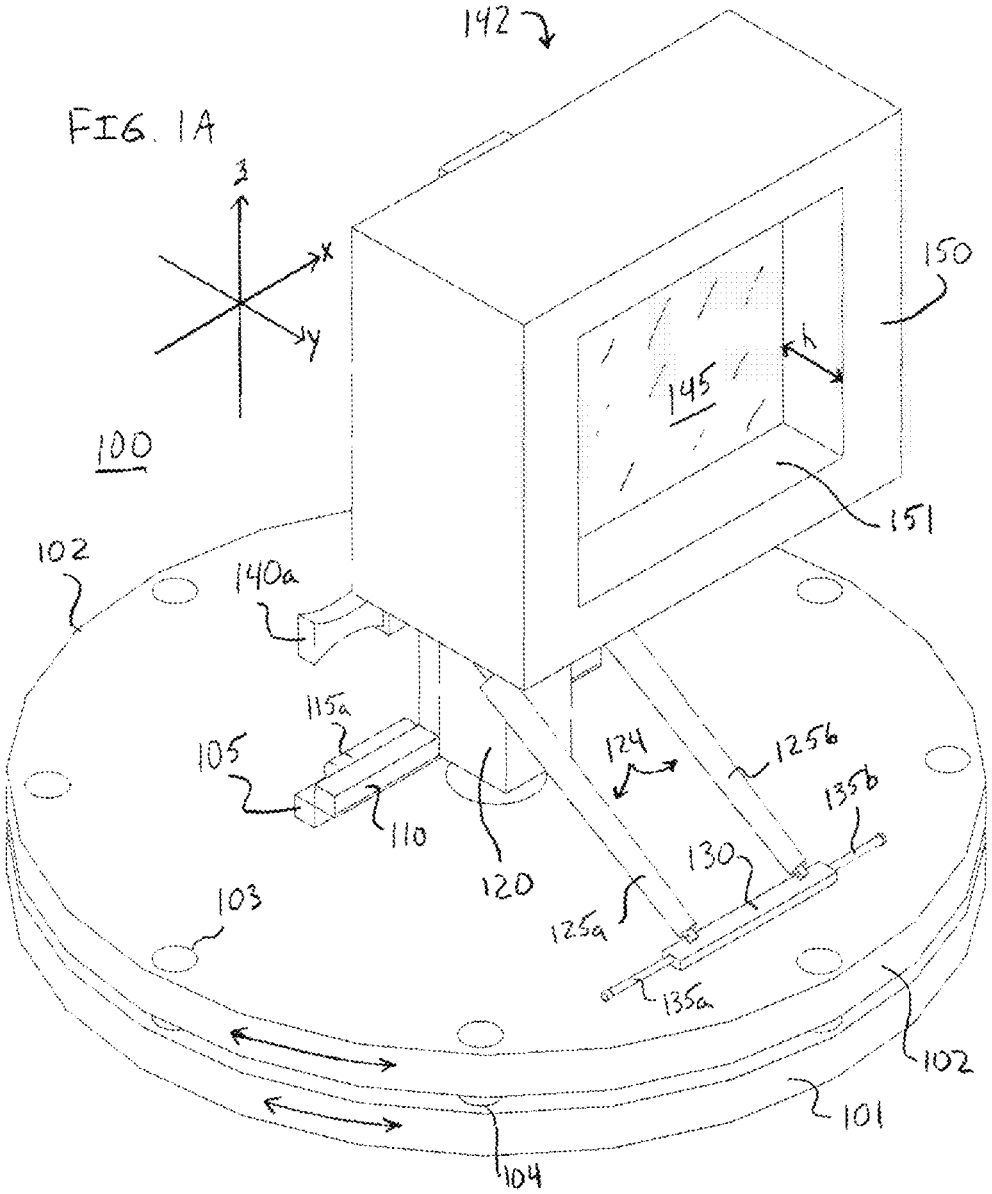
FIG. 1A is a top perspective view of a striking system, according to one embodiment.
Figure 1B:
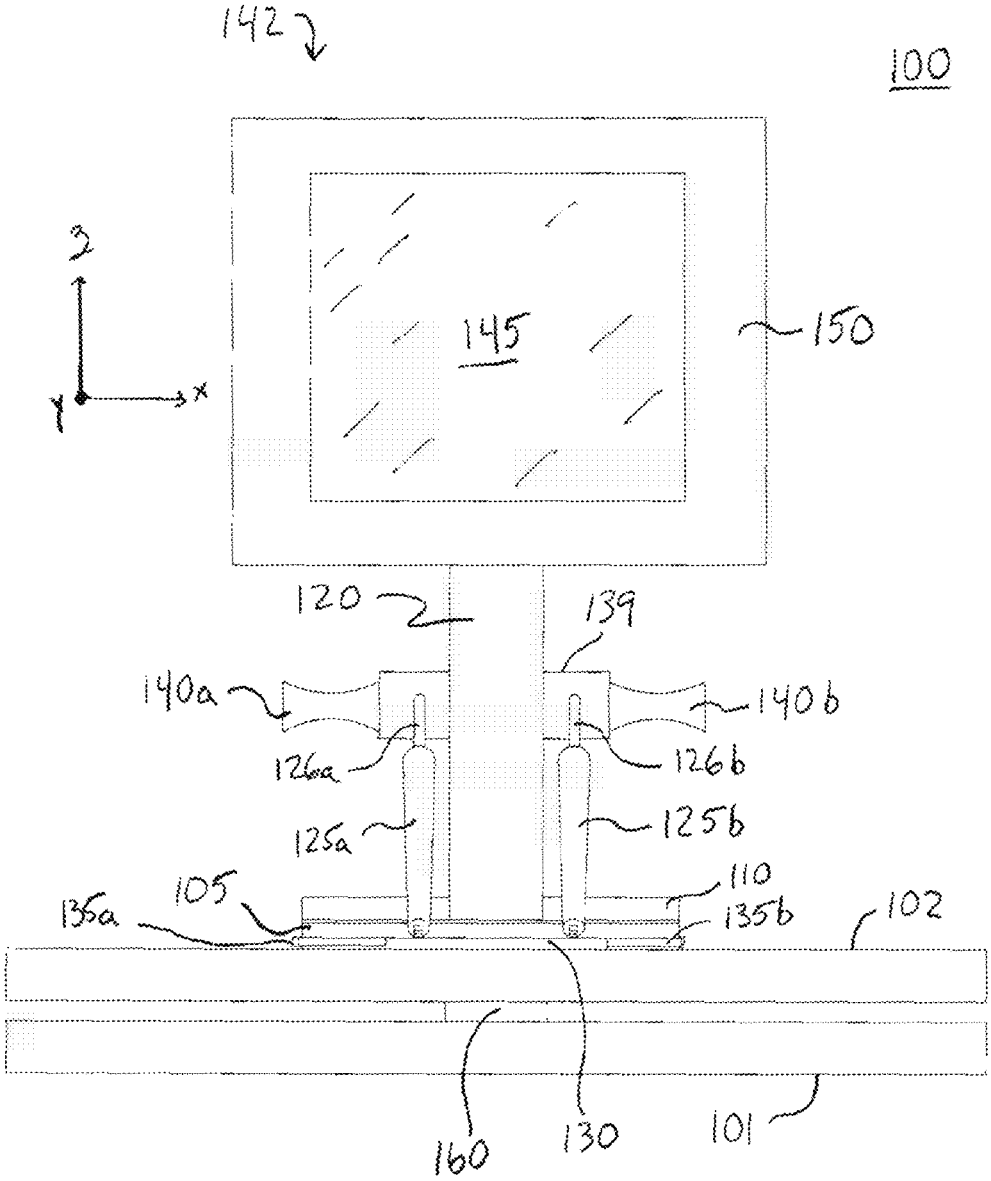
FIG. 1B is a front elevational view thereof.
Figure 1C:
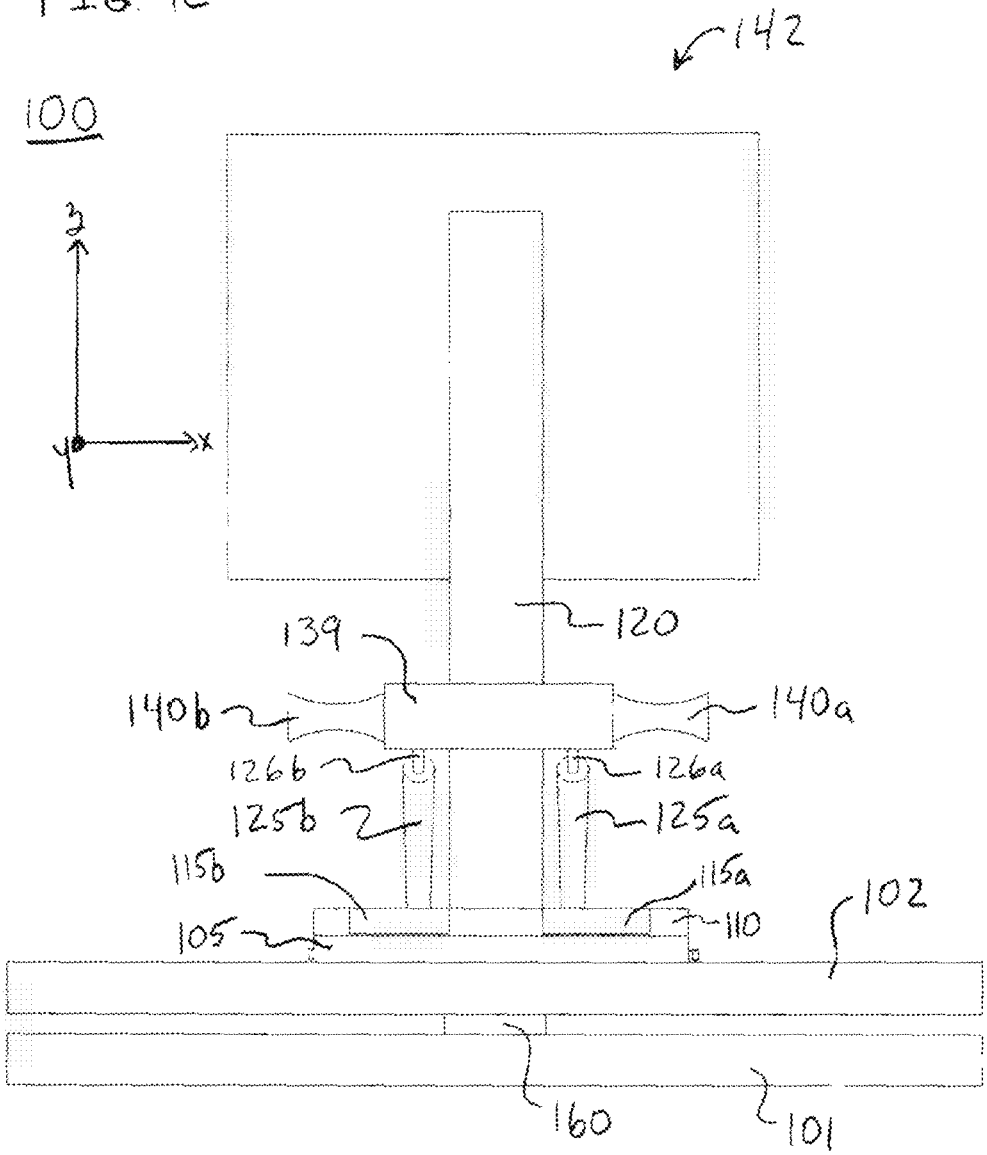
FIG. 1C is a rear elevational view thereof.

In general, systems for practicing martial arts, boxing, and related sport-fighting discipline strikes are described. In the description that follows it will be understood that references to sport-fighting includes, not by way of limitation: all forms of martial arts throughout the world, e.g., Japanese, Chinese, Korean, and Brazilian martial arts such as Karate, Kung Fu, Taekwondo, Judo, and other disciplines; so-called "cage fighting" and related forms, including Muay Thai, boxing, and others.

In general, according to one aspect, a striking system provides one or more striking pads that, when struck e.g., by a hand or foot, are shifted from a resting position, then quickly and positively return to the pre-strike position with a minimum of return-path deviation and bounce. One advantage of the striking system is that the fast reset time of the striking pad allows a user to develop their skills in executing quick combination strikes without having to wait for their target to return to its original position. Another advantage that will be realized is that the striking systems provide tactile feedback in order to improve striking form and technique. In some embodiments of a striking system, the striking pad is capable of resetting faster than the typical practitioner can recoil their hand or foot to execute another strike.

When struck, the movement of the striking pad is confined to, and follows a slightly arced path in a plane that is substantially orthogonal to the surface of the striking pad; generally, the striking pad pivots backwards in response to the strike. Because the striking pads are substantially limited to pivoting motion in one plane, a practitioner can feel, through sensory feedback, if a strike is thrown off-angle to the pivot plane. This effect can provide the basis for teaching proper form for punches, kicks, and other strikes. In a related advantage, in some embodiments, the striking surface can include one or more peripheral wall structures disposed perpendicular to the striking surface that defines a strike-approach channel path.

In some embodiments, the peripheral wall structures can be attached and detached to fit the practitioner's style or practice preferences. In some embodiments, the peripheral walls define top and bottom planes where the striking surface is disposed therebetween, such that the combination of the peripheral walls and the striking surface create a "U" shape. The strike-approach channel path can be a path of optimal approach path for a given strike, which can be determined by, e.g., an instructor. The practitioner can receive sensory feedback when throwing punches, for example, if their arm touches the wall prior to, or when contact is made with the striking surface. This feedback can be used to modify and improve the practitioner's strike form and technique. Furthermore, the one or more striking pads can be positioned in three-dimensional space, allowing a user to hone particular striking skills that are thrown from various directions, such as "uppercut" punches, round-house kicks, etc. Furthermore still, the configuration and action of the striking pad support mechanism, described in greater detail below provides a realistic feel to the practitioner, similar to striking a human opponent. These and other aspects are described in greater detail below with reference to the figures.

Referring now to FIGS. 1A-1G, one embodiment of a striking system 100 is shown. It will be understood that the configuration, layout, and design of the striking system 100 shown in FIGS. 1A-1G can be modified according to user preference while maintaining the functionality and advantages of the striking system as described herein.

The striking system 100 includes a mountable base 101 that can be mounted, e.g., on a wall or other support structure and can be composed of wood, plastic, or similar materials that provide a rigid support base. In this embodiment, the base 101 includes apertures arranged circumferentially as shown for receiving mounting hardware, e.g., bolts, rivets, etc., that can be used to securely attach the base 101 to a wall or other support structure. (Only aperture 104 is indicated on the base 101 for clarity of the figures.) Preferred embodiments include a plurality of apertures positioned on a peripheral edge so that mechanical stress or shearing is minimized between the base 101 and the wall or other support structure when a user strikes the pads from different angles, as described herein.

A shaft 160 provides coaxial attachment between the base 101 and a rotatable platform 102. In this embodiment, the attachment position of the shaft 160 is in the geometric center of the circular base 101 and platform 102 so as to provide coplanar rotation of each about the z-axis as shown. (In this embodiment, coplanar rotation of the base 101 and the platform 102 is about the z-axis, in the x-y plane; arrows on the side of the base 101 and platform 102 indicate the direction of rotation.) Without limitation, the shaft 160 can be an axle, a ball-bearing system, or any other hardware capable of providing both attachment and rotation between the base 101 and the platform 102.

In this embodiment, the rotatable platform 102 includes apertures arranged circumferentially that can be used with a locking mechanism to lock the rotation angle between the base 101 and the platform 102 at a preferred angle. In one non-limiting example of a locking mechanism, one or more pins can be used that extend through the platform 102 aperture(s) and positively engage one or more complementary aperture(s) in the base 101. Preferred pins for this use include, not by way of limitation, cotter pins, clamp pins, weld-on pins, and surface-mounted spring-loaded plungers which are commonly used on fitness equipment and racking systems. Spring-loaded plungers can be particularly useful for setting a preferred rotation angle between the base 101 and the platform 102 quickly. The platform 102 can be composed of the same material(s) as the base 101, including, not by way of limitation: wood, plastics, metals, and other solids providing a rigid support surface.

In this embodiment, the striking system 100 includes a striking assembly 142 configured to receive strikes from the user, e.g., hand or foot strikes as described more fully below. The striking assembly includes an elongate arm 120, a striking pad 145 attached thereto, and, optionally, a peripheral wall portion 150 that extends outwardly, i.e., normal to, the exposed surface of the striking pad 145 as shown. The striking pad 145 can be securely attached to the elongate arm 120 to reduce the likelihood that the pad will become dislodged or twist relative to the elongate arm 120 when struck. In one embodiment, the elongate arm 120 is an elongate rectangular-shaped arm having a width that substantially matches a width of the striking pad 145 when viewed from a frontal perspective, e.g., the perspective shown in FIG. 1B. In another embodiment, reinforcement members such as cross-bars can be used to securely attach the striking pad 145 to the elongate arm 120.

The shape and size of the striking pad 145 is not limited to the embodiment shown in the figures; indeed, the striking pad 145 can be any size and shape according to user preference. For example, the striking pad 145 can be circular, square, rectangular, octagonal, etc. In one embodiment, the striking pad 145 is rectangular in shape and has a striking surface area of about 1 $ft^2$. Similarly, the depth of the striking pad 145 can have a desired amount of padding that suits the user's preference and practice style.

The elongate arm 120 can be attached to a support member 110 which is hingedly attached to a base support member 105 via one or more hinges 115*a*, 115*b*. It will be understood that the shape of the elongate arm 120 and its hinged attachment mechanism as shown in FIG. 1 are each one of many alternatives for connect the striking pad 145 to the support member 105 in a way that allows the pad to swing or pivot in response to being struck by, e.g., a hand, fist, or foot. In one alternate embodiment, a functional equivalent to the elongate arm 120 includes a substantially rectangular-shaped brace support configured to securely attach the striking pad to one side, and hingedly attach to the base support member 105 at an opposite side. In one alternate equivalent, the attachment mechanism can include a coiled spring connected between the base support member 105 and the elongate arm 120, which allows the elongate arm 120 to move when the pad is struck, then resiliently return to its original, pre-strike position.

The base support member 105 is securely attached to the platform 102. As most easily recognized in FIG. 1G, the hinged connection between the base support member 105 and the support member 110 allows shifting of the striking assembly 142 from a first position, where the elongate bar 120 is substantially normal to the platform 102, to a second, pivoted position, where the elongate arm 120 and support member 110 are shifted in the y-z plane about the hinge axes through a pivoting motion as illustrated by arrow 106. (Components of the striking system illustrated in the second position are indicated with underlined reference numbers in FIG. 1G for figure clarity.) Arrow 106 is used in FIG. 1G for indicative purposes, and shows the slightly arced path of the striking assembly 142 in the y-z plane when shifting from first to second positions and vice-versa.

In this embodiment, the elongate arm 120, support member 110, and base support member 105 are square-tubular steel bodies, however, other material(s) can be substituted that provide similar structural stability and functionality. Non-limiting examples of alternative materials include: plastics, woods, metals and metal alloys, and similar materials; similarly, the bodies can be solid pieces and cast in other shapes, such as circular-tubular, or other shapes as preferred by the user or manufacturer.

In this embodiment, the striking system 100 includes a pair of pneumatic spring systems 124 having a body portion 125*a*, 125*b*, respectively, and a spring-loaded piston portion, 126*a*, 126*b*, respectively. The spring systems 124 can serve multiple purposes: a first purpose is to control, in part, the pivoting motion of the striking assembly 142 in the y-z plane; a second purpose is to return the striking assembly 142 to its pre-strike position; a third purpose is to provide user-adjustable variability in the tension or resistance felt by the user when they strike the striking pad. The body portion 125*a*, 125*b* of the spring systems 124 are attached at one end to a stabilizing bar 130 which itself is attached to the platform 102; the piston portions 126*a*, 126*b* of the spring systems 124 are attached at a distal end to a cross-bar 139 which itself is attached to the elongate arm 120 of the striking assembly 142.

One non-limiting example of a pneumatic spring system is a piston-type "storm door" closer. Analogous to the functionality of a storm door closer, the spring system 124 allows the striking assembly 142 to shift from a first, resting position to a second, non-resting position while providing some resistance in the direction of motion via an internal spring that connects the piston 126*a* to the main body 125*a* of the closer (the spring is not shown in the figures for clarity). When the striking assembly 142 is shifted from its resting position (e.g., wherein the elongate arm 120 is normal to the surface of the platform 102), the piston 126*a* concomitantly shifts from a first position within the body portion 125*a* to a second position against the resistance of the internal spring. The spring system 124 is capable of returning the striking assembly 142 from the second position back to the first position through the retracting force of the stretched spring. The speed with which the striking assembly 142 is capable of returning to its original position can be controlled, in part, through variable pneumatic pressure that slows the return of the piston 126*a* from the second position back to the first position, similar to how a storm door closer can close a door with adjustable speed or force. One non-limiting example of a piston-type storm door closer that can be used in this and other embodiments is the Stanley 74-8300 closer, sold by Stanley Black & Decker, New Britain, Connecticut, USA.

In this embodiment, the striking assembly 142 includes a striking pad 145 configured to receive strikes from a user. The striking surface can include, e.g., pads, or layers of pads, or other striking surfaces that are commonly used in sport-fighting training pads and the like. In one embodiment, the pads or layers of pads can be mounted on a solid surface that attaches to the elongate arm 120, e.g., at a terminal end of the elongate bar. The pads or layers of pads can be any desired thickness and composed of materials suitable for sustaining repeated strikes from, e.g., hands and feet of the user. Suitable materials include, not by way of limitation, pads made for boxing, martial arts, and similar disciplines; so-called "heavy bag" materials, foams, pillows, and other materials.

In this embodiment, the striking pad 145 is surrounded by a peripheral wall 150 that protrudes a height h from the striking pad 145 as indicated most clearly in FIG. 1A. The wall protrudes substantially normal to the striking pad 145, forming an open-ended column or channel around the striking pad 145 that defines a preferred approach path for strikes. As described previously, the column provides tactile feedback to the user relating to their punching or kicking technique. The height h of the column can be selected according to user preference. In some embodiments, the height can be set during manufacture and is not adjustable; in other embodiments, however, the height h of the column can be adjusted from, e.g., a "zero" height (where the top of the wall 150 is co-planar with the striking pad 145), to a maximum height h which may be, e.g., 6 inches. In one example of such an embodiment, the wall portion 150 and the striking pad 145 are separate bodies, slidingly engaged so as to allow the wall portion 150 to shift relative to the striking pad 145, thereby varying the height h of the wall 150. Such sliding engagement can be achieved, e.g., through use of a tongue-and-groove system where one body (e.g., the wall 150) includes a protruding tongue on the interior of the wall portion, and the other body (e.g., the striking pad 145) has a complimentary groove on a peripheral surface that receives the tongue and allows the wall 150 and the striking pad 145 to slide relative to each other. A preferred relationship between wall 150 and striking pad 145 can be fixed, e.g., through use of a locking lever, bolt, or other locking mechanism.

Still referring to FIGS. 1A-1G, in this embodiment, one or more bands can be used to provide additional resistance to the pivoting motion of the striking assembly 142 when it is struck by the user. While not shown in FIGS. 1A-1G for clarity purposes, one or more bands, e.g., elastic bands, can be looped from protruding fingers 135*a*, 135*b* on the stabilizing bar 130 to arm members 140*a*, 140*b* on the elongate arm 120, respectively. The arm members 140*a*, 140*b* have a double-concave shape when viewed from the front or rear, e.g., from the perspectives shown in FIGS. 1B and 1C, respectively, to reduce the likelihood of the bands slipping off during use. Similarly, fingers 135*a*, 135*b* include discs on the terminal ends for the same purpose. It will be understood, however, that the arm members 140*a*, 140*b* and the fingers 135*a*, 135*b* can be any shape to achieve the same functionality.

In this and other embodiments, the strike resistance, i.e., the amount of swing or pivoting motion of the striking assembly 142 that occurs when the user strikes the striking pad 145 can be controlled in part by use of one or more bands as just described. In some embodiments, a series of bands having different elastic properties, and therefore providing different strike resistance, can be included with the system 100. For example, bands of varying thickness can be included with the system 100 where thicker bands provide more pivot resistance, and thinner bands provide less pivot resistance. Accordingly, through use of one or more bands, a user can fine-tune the amount of strike resistance encountered when striking the striking assembly 142. In one embodiment, the amount of resistance the user encounters when striking the pad can be controlled in whole or part by incorporating a plurality of shock-absorbing mechanisms, similar to automobile shock absorbers. In one embodiment, a shock-absorbing mechanism is a coiled spring attached between the base support member 105 and the elongate arm 120 that provides a desired amount of resistance to the pivoting motion of the elongate arm 120.

The striking system 100 can be used in martial arts, boxing, and other fight-science disciplines not only for work-out purposes, similar to training on a heavy bag, but also to teach a preferred form or style of kick, punch, or other strike. For example, some disciplines teach that punches should be thrown with hand, wrist, and forearm oriented in a substantially straight line, and that the strike should be delivered to its intended target similarly along a substantially straight path for maximum effectiveness. Those familiar with this style will recognize that some practitioners improperly "hook" their punches which may reduce effectiveness.

The striking system 100 can correct improper striking techniques by providing tactile feedback to the practitioner, in part through the wall portion 150. As described above, the wall portion 150 can form a column around the striking pad 145, thereby defining a clear-space entry path for the strike (e.g., a kick or punch). Using a punch as an example, if the user hooks their arm, or throws the punch with a swinging motion instead of using a straight-in approach, their arm can contact the wall surface which they can recognize through tactile feedback as an improperly-thrown punch. In a similar example, some fighting styles teach that a strike should be "retracted" along substantially the same path from which it originated, so as to reset the arm, or leg into a position to quickly throw another strike. Using similar tactile feedback, a user can feel if, e.g., their hand contacts the wall 150 during follow-through of the punch. This can indicate to the user that their punch has a "swinging" component that may need to be corrected.

In this and other embodiments, the height h of the wall 150 can be selected according to the type of strike the user wishes to practice. For example, a user may wish to work on "uppercuts" and focus on delivering the strike using a straight-in approach path. In this circumstance, the user can use a striking assembly 142 having a relatively tall wall column (large height h). In some situations, however, such as practicing close-combat with short, quick strikes, the user may wish to use a striking assembly 142 having a relatively short wall (small height h).

In this embodiment, another tactile feedback component of the striking system 100 is realized by virtue of the pivoting motion of the striking assembly 142 in a substantially two-dimensional plane (the y-z plane, as illustrated in FIGS. 1A-1G). As those skilled in the art will appreciate, and referring to FIG. 1G in particular, various components of the system 100, such as the hinged base support member 105, the support member 110, and the spring system(s) 124, act to restrict the pivoting motion of the striking assembly 142 to a single plane. Thus, when a user throws a punch or a kick that is substantially within the same plane as the plane of allowed pivoting motion of the striking assembly 142, a positive tactile response is received from the absence of any counteracting forces felt from out-of-plane resistance provided by structural components of the system 100. Similarly, if the striking assembly 142 is struck with a punch having directional components that are outside of the plane of pivot motion (e.g., the y-z plane in FIG. 1G), the user may receive tactile feedback in the form of torsion, compression, strain, or other uncomfortable feedback in the bones, joints, and other body parts.

Figure 1D:
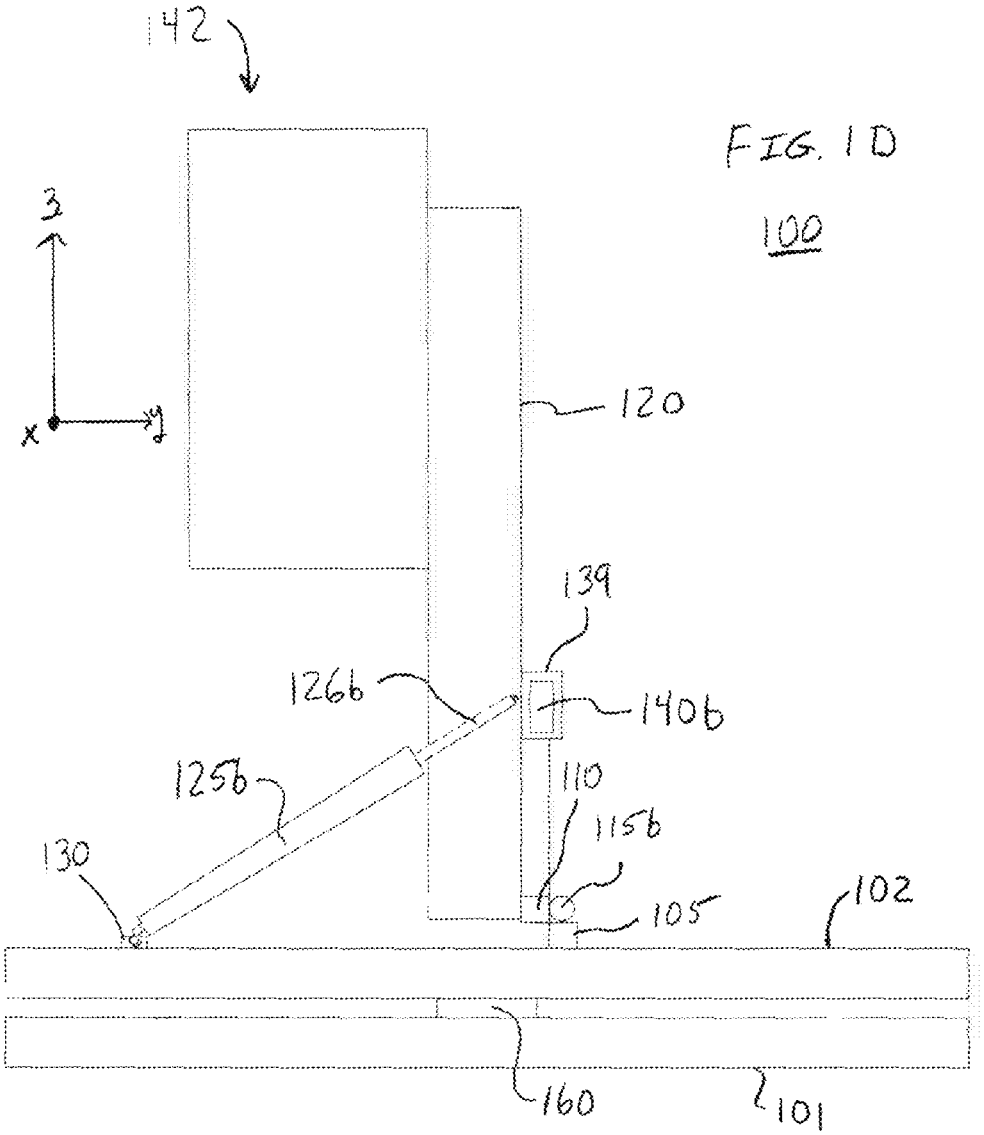
FIG. 1D is a side elevational view thereof.
Figure 1E:
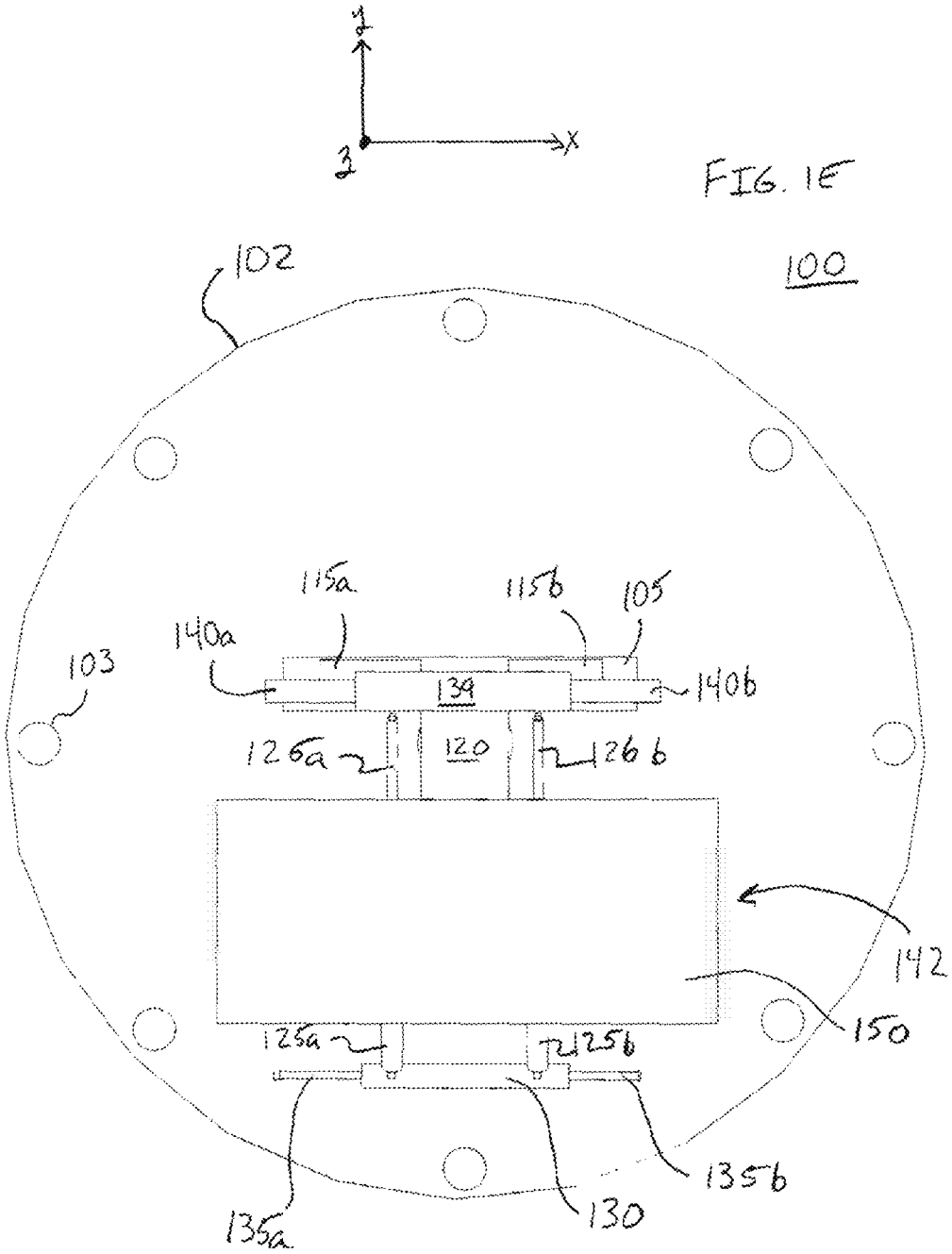
FIG. 1E is a top plan view thereof.
Figure 1F:
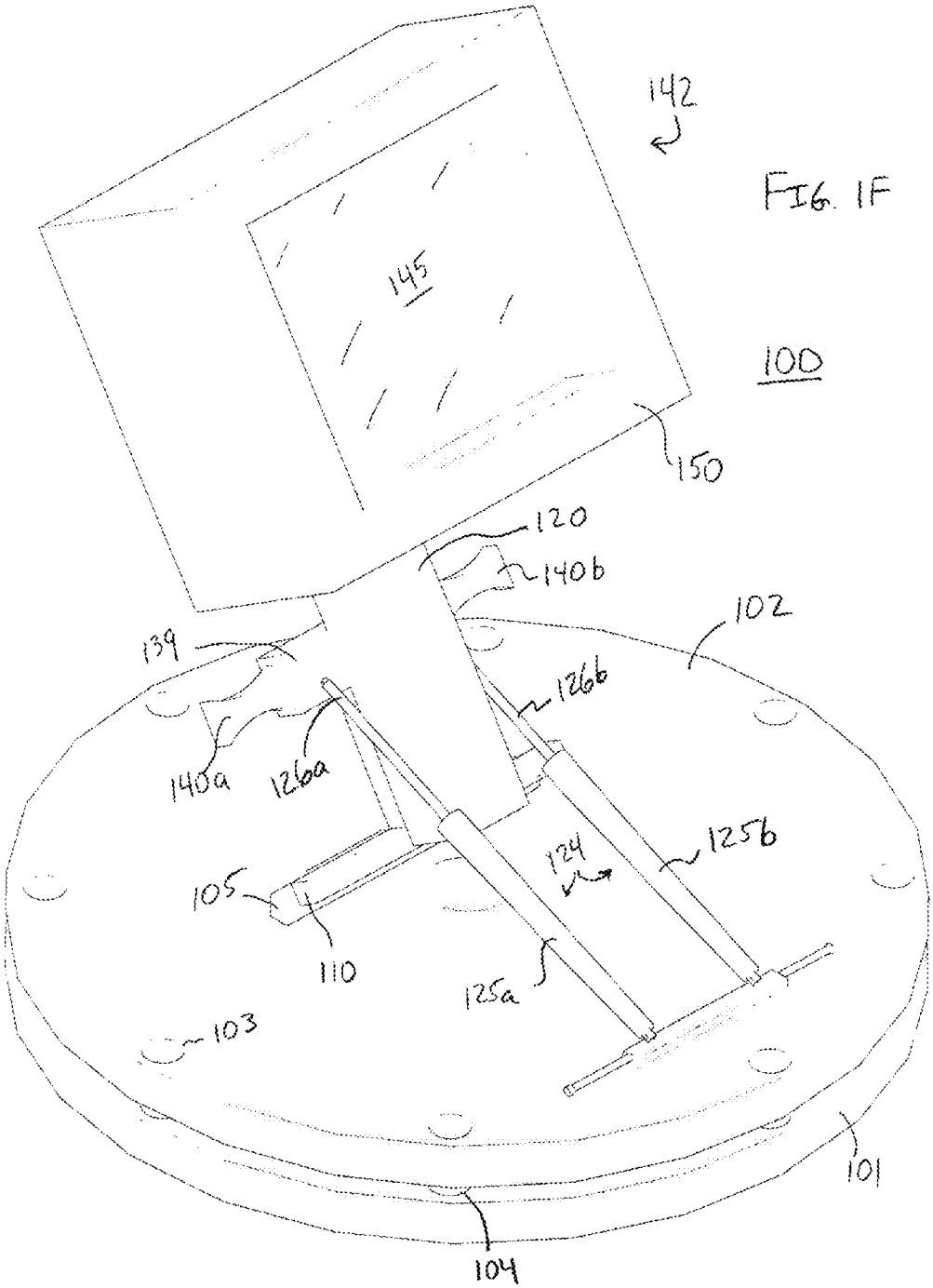
FIG. 1F is a top perspective view thereof, showing the system in a pivot-shifted position.
Figure 16:
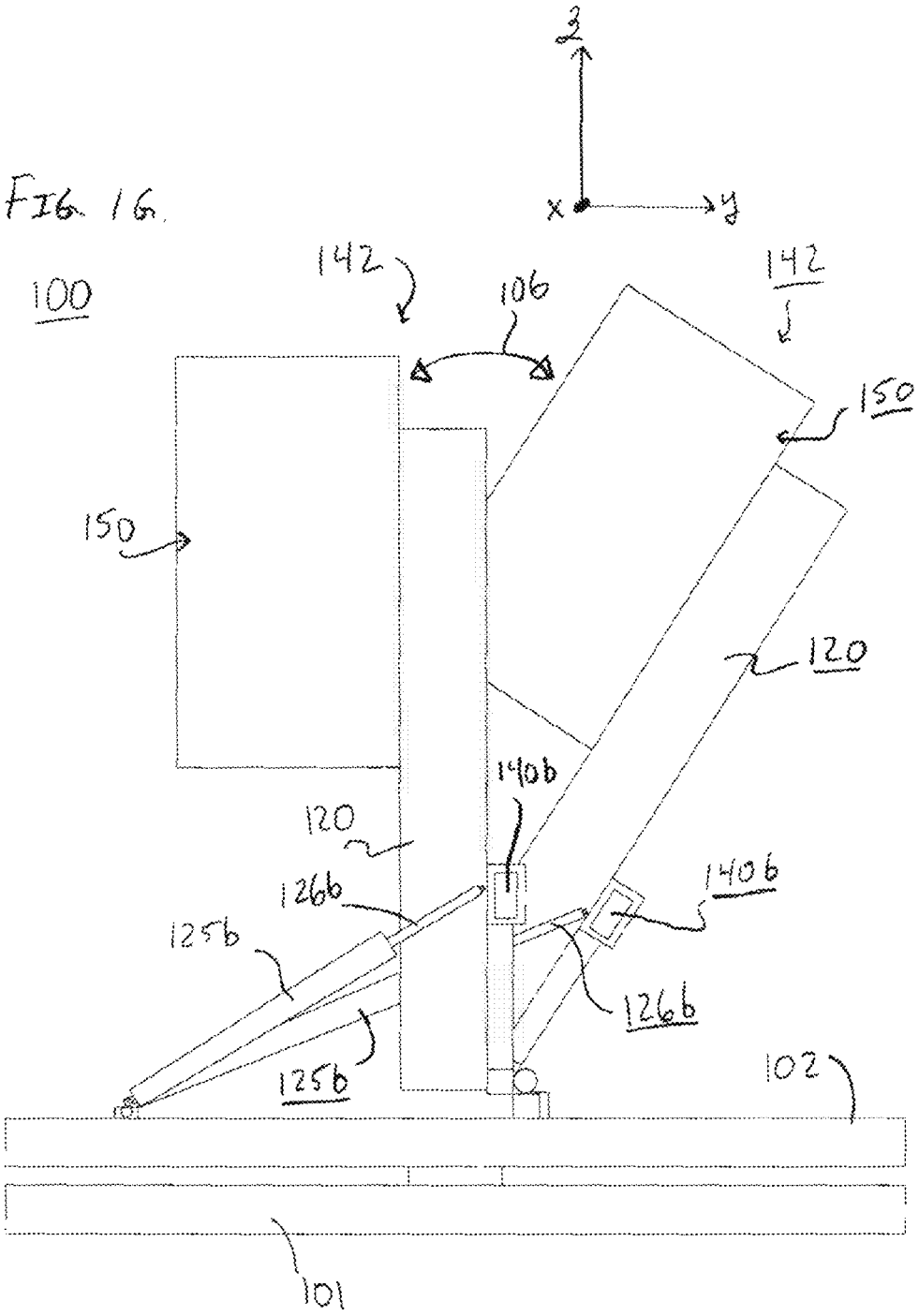
Figure 1H:
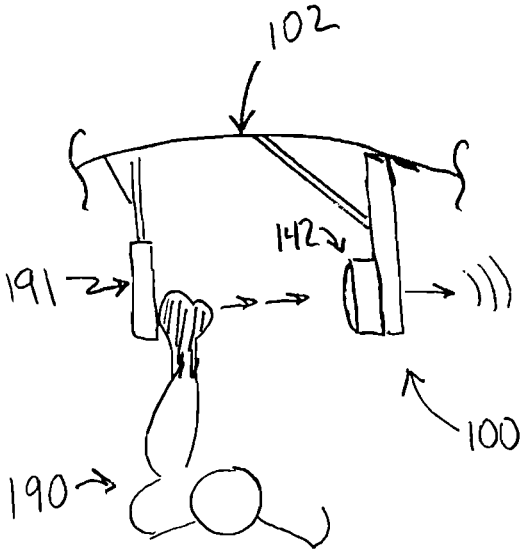
FIG. 1H is a top plan view thereof.

Referring now to FIG. 1H, in this embodiment, the striking system 100 includes an optional brace 191 that can serve to define the user's strike starting position. In some fighting disciplines, a user can benefit from practicing "short" strikes, where there is very little distance between the hand and the intended target. The "one-inch punch" made famous by martial artist Bruce Lee exemplified this technique that originated from southern Chinese martial arts. The short-strike technique can be useful in close-combat situations. Advantageously, this embodiment of a striking system provides a user a way of practicing short-strike punching, which can train appropriate muscle groups and also teach valuable skills to the user, including follow-through, accuracy, and other aspects.

In this embodiment, an adjustable brace 191 can define the start point of a strike that is intended to land on the striking system 100 as illustrated. The brace can be, e.g., a pad, a length of rigid tubing, a block, or any other material suitable to define a starting position for the user's hand or foot. In practice, a user 190 can begin with his hand (or foot) touching the brace, and then hone his skills in delivering quick, accurate, and powerful strikes to the striking assembly 142. The brace 191 can be adjustable so that its position can be selected by the user to practice short strikes from any desired distance or angle from the striking assembly 142. The user can also adjust the striking system 100 accordingly so that the striking assembly 142 is at a preferred orientation to the brace 191.

In this and other embodiments, the striking system 100 can include visual or auditory indicators for alerting the user of a properly-delivered strike. A properly-delivered strike can be defined by, e.g., a user or a trainer to indicate a certain amount of force delivered to the striking assembly 142. For example, a bell can be integrated with the striking system 100 such that when the elongate arm pivots back beyond a critical angle (angle 106 in FIG. 1G) after the striking assembly 142 is struck, the bell sounds. In this and other embodiments, the resistance of the striking assembly 142 can be adjustable so that the force required for moving the striking assembly 142 beyond the critical angle is selectable according to user preference.

Figure 2A:
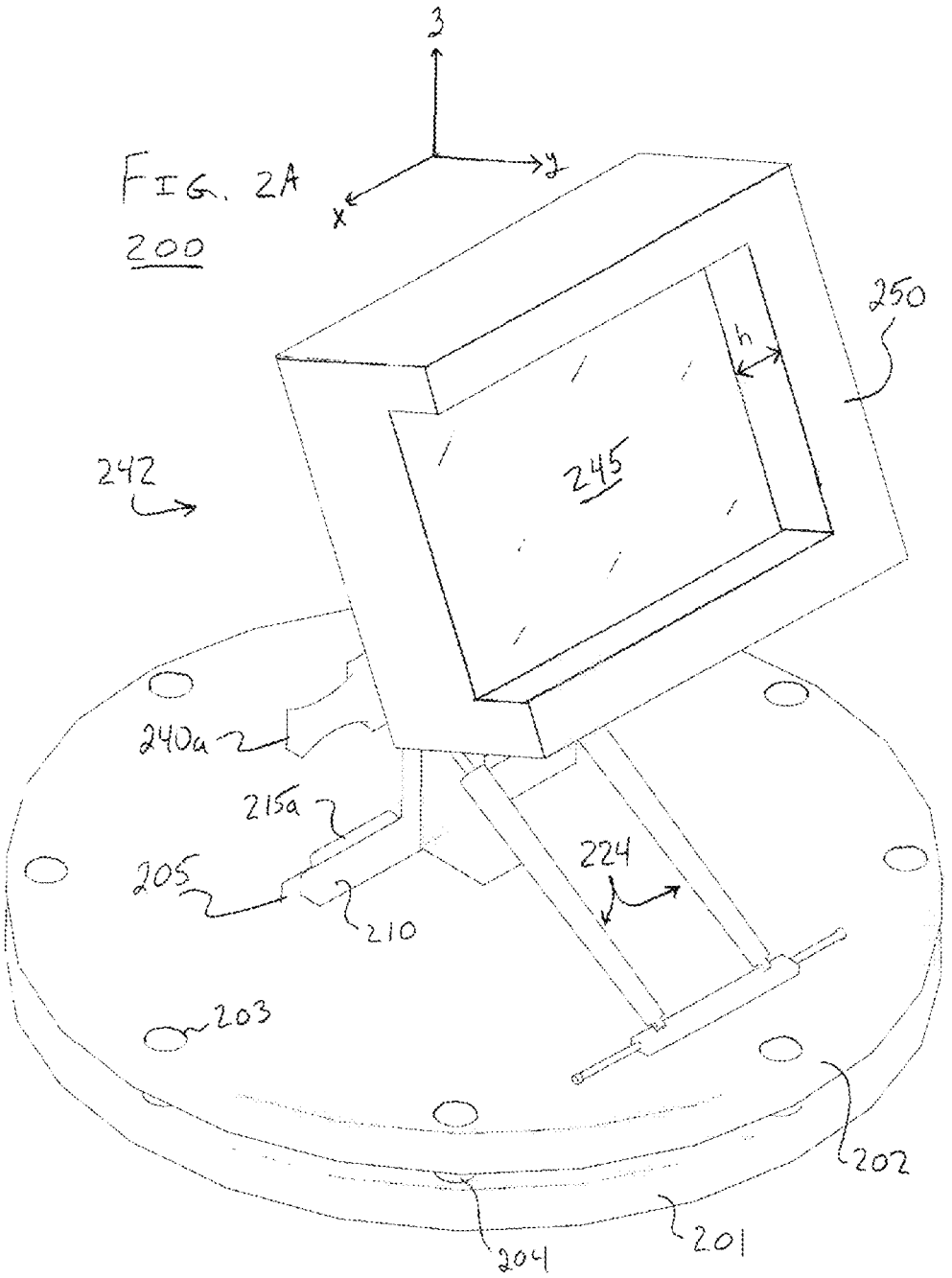
FIG. 2A is a top perspective view of a striking system, according to one embodiment.
Figure 2B:
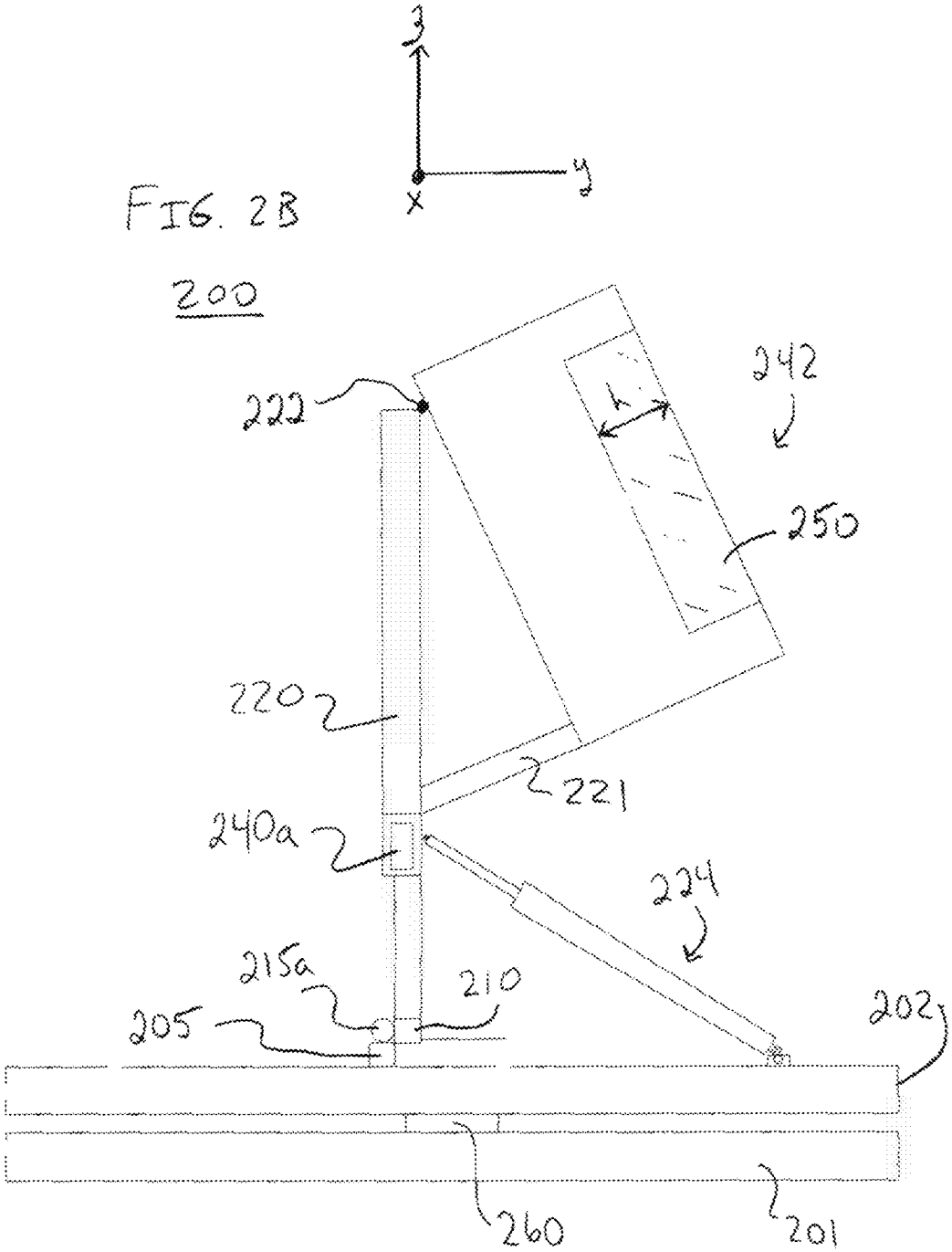
FIG. 2B is a side elevational view thereof.

Referring now to FIGS. 2A-2B, one embodiment of a striking system 200 is shown. Many of the features of the striking system 200 are similar to the striking system 100 described with respect to FIGS. 1A-1G, above. (Accordingly, similar features between systems 100 and 200 share the same reference number shifted by a value of one hundred.) The system 200 includes a striking assembly 242 that includes a striking surface 245 and a wall portion 250. In this embodiment, the wall portion 250 surrounds the striking surface 245 on three sides, although in other embodiments, the wall portion 250 can surround the striking surface 245 similar to that shown in FIGS. 1A-1G. The open-ended feature of the wall portion 250 can allow a user to strike the striking surface 245 with a foot, elbow, or other body part that may otherwise contact the wall portion when attempting to strike the striking surface 245. Furthermore, in some embodiments, the wall portion 250 can have any number of sides, e.g., one, two, three, four sides, etc. This allows users to practice delivering strikes with any body part, for example, feet, knees, elbows, etc. As those skilled in the art will appreciate, kicks such as the "roundhouse" kick can be delivered with the top of the foot; therefore, to allow the top of the foot to contact the striking surface 245, one of the walls can be removed, while still providing a straight-channel path for teaching a preferred form or style of strike. The design of the wall portion 250 and the number of walls thereof can be chosen by the user for various intended sport-fighting styles that will be apparent to skilled artisans.

In this embodiment, portions of the striking assembly can be adjusted to vary the facing angle of the striking surface 245. The striking surface 245 and wall portion 250 can be hingedly attached to an elongate arm 220 which is similar in form and function to elongate arm 120 described with respect to FIGS. 1A-1G. In this embodiment, hinge 222 is attached to a terminal end of elongate arm 220 as shown; however, the hinge can be positioned elsewhere on the elongate arm 220 according to user preference. A stabilizing bar 221 can lock the facing angle of the striking surface 245 in place as illustrated in FIG. 2B.

In this and other embodiments, one advantage of the systems described herein is the ability to orient the face of the striking surface 245 in practically any direction. This provides the user a high degree of customization when practicing kicks, punches, and other strikes on the system. A related advantage is that the striking assembly always pivots substantially straight back within an orthogonal plane to the striking surface, as previously described, regardless of which way the striking surface is oriented when struck by the user. Thus, for example, a practitioner can practice cross-uppercut strikes on the system, where the punches are thrown at a 70-degree, upward angle from horizontal. In such an example, the user can set the striking surface at a 70-degree down-facing angle from horizontal; any punches thrown off-angle (e.g., 60 degrees from horizontal) will result in tactile feedback to the user, either through contact with one or more wall portions (e.g., portion 250); or through resistance from structural components of the system from resisting off-angle shifting of the striking assembly; or both.

As those skilled in the art will appreciate, practitioners of the fight sciences come in many shapes and sizes, each being able to deliver more or less payload or power in their strikes. The striking systems described herein are dynamic in the ability to provide a practice striking system that is customizable for the user. For example, a heavyweight user can add bands, shock absorbers, springs, or combinations thereof to increase the level of pivot-resistance encountered when striking the striking pad. Similarly, lightweight users can use smaller bands that provide less pivot-resistance. Furthermore, a user can incorporate resistance bands on all, or select striking systems in a multi-system assembly, as described next.

Figure 3:
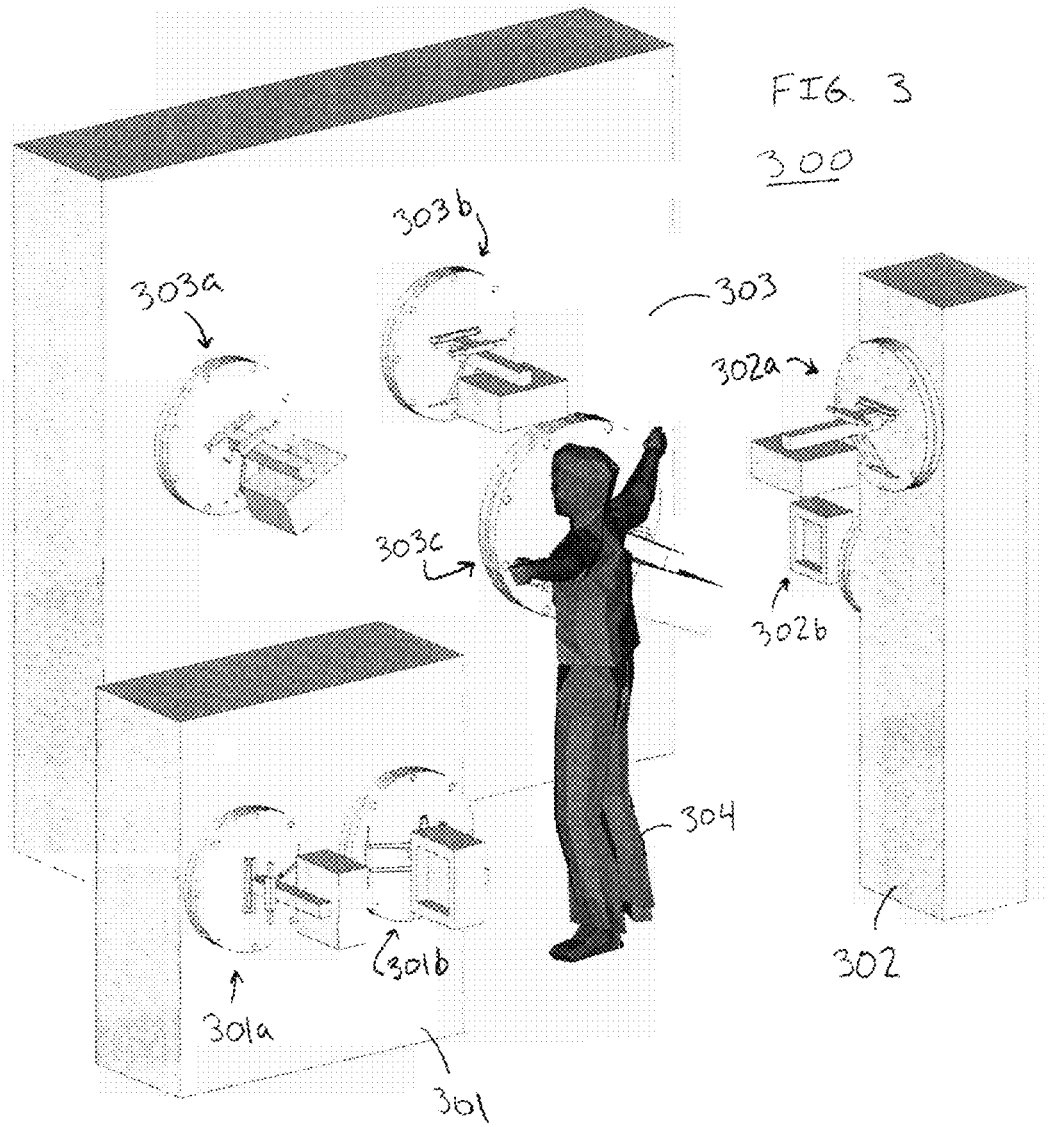
FIG. 3 is a perspective view of a striking system assembly, according to one embodiment.

Referring now to FIG. 3, a multi-system assembly (hereinafter "assembly") 300 is shown. In this embodiment, multiple striking systems are shown in different orientations and mounted on wall bodies 301, 302, 303 of varying physical dimensions. The striking systems in this embodiment can be, e.g., the striking systems described with respect to FIGS. 1A-2B, or striking systems having combinations of features thereof. For example, wall body 301 includes two striking systems 301*a*, 301*b* that could be used, e.g., for practicing kicks, sweeps, and other strikes by the feet, shins, knees, etc. Wall body 302 includes two striking systems 302*a*, 302*b* that could be used, e.g., for practicing combination uppercut (system 302*a*) and straight-in punches (system 302*b*). Wall body 303 includes three striking systems 303*a*, 303*b*, 303*c* that are similarly set to practice combination strikes; in this embodiment, striking system 303*c* is larger than the other striking systems 303*a*, 303*b* and could be used for practicing shin- or knee-strikes on a larger target area. Further customization of the assembly 300 can be provided by utilizing one or more of the previously-disclosed resistance bands on one or more of the systems (e.g., systems 303*a*, 303*b*) to create different resistance to strikes. As those skilled in the art will appreciate, the capability to mount striking systems on various surfaces, at various heights, angles, and positions, can provide unique practice and work-out routines that can hone practitioners' skills in many of the martial arts and boxing disciplines.

Figure 4:
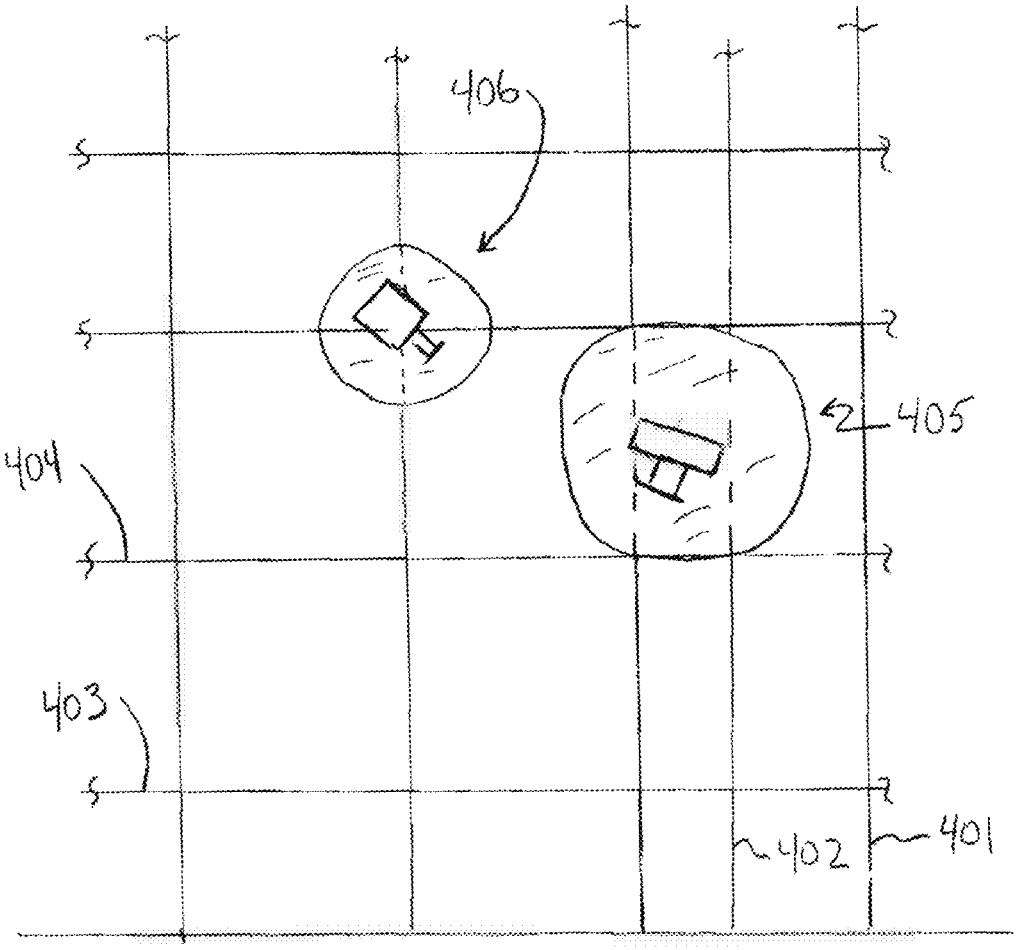
FIG. 4 shows a plurality of striking systems on a track assembly, according to one embodiment.

Referring now to FIG. 4, striking systems are shown mounted on a track assembly 400 according to one embodiment. In this embodiment, a track assembly 400 includes a plurality of strut channels arranged vertically (e.g., rails 401, 402) and a plurality of strut channels arranged horizontally (e.g., rails 403, 404) so as to form a matrix, as shown. Exemplary strut channel materials for this purpose include "Unistrut," "Kindorf," "SuperStrut," and other related products, although other rail, track, and similar mounting hardware are equally contemplated. The strut channels can be spaced according to user preference and to maximize the functionality of the system. Two striking systems, 405 and 406 are shown attached to the assembly 400. In this embodiment, the striking systems 405, 406 are anchored to the assembly 400 preferably via one or more fasteners that provide quick-release and attachment functionality. In one example, the fasteners include a Unistrut channel nut positioned within the strut channel and a complimentary bolt that extends through an aperture in the base of the striking system (e.g., base 101 described with respect to FIGS. 1A-1G) and into the channel nut, thereby fastening the base to the strut channel. The striking systems 405, 406 can be positioned anywhere on the assembly 400, allowing the user to practice strikes in a variety of locations and in preferred combinations.

One advantage of the striking systems described herein is the fast, and, in some embodiments, customizable "reset" time. The reset time is the time it takes a striking body to return from its point of furthest pivot-displacement after being struck, to its pre-strike, resting position. In most embodiments, the resting position is one in which the striking body is substantially perpendicular to the platform, e.g., as depicted in FIG. 1D, however, the resting position can be set according to user preference in other embodiments. The extent to which the striking body will be pivot-displaced from the resting position can depend on several factors, including how hard the striking surface was hit, the tension provided by spring systems (e.g., spring systems 124), and the elasticity of any tensions bands, if used. The same factors can influence the reset time. Accordingly, the reset time can be adjusted by controlling some or all of these variables, e.g., by adjusting spring tension of the spring system, use of tension bands, etc.

In some embodiments, the reset position can be controlled by the spring system (e.g., spring system 124) alone; in other embodiments, the reset position can be, in part, controlled through use of a stop arm or body. A stop arm or body can be, e.g., a rigid member having a first side or end attached to the platform of a striking system, and a second side or end not attached or connected to the striking body, but which is capable of stopping the striking body from pivoting beyond a determined point (preferably about 90 degrees from the platform). In one embodiment, a strap, e.g., one made from nylon or an alternative suitable material can be coupled at opposite ends to the elongate arm 120 and a section of the base 102 respectively. The strap can be configured such that it collapses when the striking pad is struck, allowing the elongate arm 120 to pivot as described herein. However, the strap can be used to stop the elongate arm 120 at the original (e.g., pre-strike) position when it recoils under urging forces provided by springs or other mechanisms described.

A number of illustrative embodiments have been described. Nevertheless, it will be understood that various modifications may be made without departing from the spirit and scope of the various embodiments presented herein. For example, a striking system can include elements of different embodiments described herein; for example, an open-walled wall portion 250 (FIG. 2A) can be exchanged for the closed-wall wall portion 150 (FIG. 1A). The spring systems (e.g., spring systems 124, 224) can be exchanged for materials, systems, hardware, or devices that provide similar functionality to that described above. Suitable spring systems include struts, springs, door-closers, coiled springs, and the like. While the systems describe above are shown and described having circular bases and platforms, and those systems are illustrated as attached to a flat wall, it will be understood that striking systems of the types described herein can be mounted on rails, poles, cages, or any other structure using methods known in the art. Accordingly, other embodiments are within the scope of the following claims.

What is claimed is:

1. A system for practicing striking, comprising:

a base support member;

a support arm hingedly connected to said base support member capable of swinging from a first, at-rest position, to a second, post-strike position within a striking plane;

a striking surface attached to an end of said support arm configured to be struck by a body part of a practitioner;

a return mechanism configured to resiliently return said support arm from said post-strike position to said at-rest position after the striking surface has been struck; and a mounting assembly having rigid, crossed span members; wherein said base support member is capable of being mounted to said mounting assembly via one or more attachment mechanisms;

wherein said striking surface comprises one or more wall members extending from said striking surface configured to illicit a tactile response in said practitioner at or near said body part, if touched during the delivery of a strike, indicative of an amount of deviation in a predetermined strike path as said practitioner delivers a strike to said striking surface.

2. The system of claim 1, wherein said system is capable of providing a tactile response to said practitioner indicative of an amount of out-of-striking plane force applied to said striking surface by said body part when executing a strike.

3. The system of claim 1, wherein said first, at-rest striking position of said striking surface is configured to be selectably orientated in each of three dimensions, wherein orientation in one of said three dimensions is accomplished by rotation of said base support member.

4. The system of claim 1, wherein said predetermined strike path is substantially defined by an area extending from, and tangential to said striking surface, exclusive of said one or more wall members.

5. The system of claim 4, wherein said striking system comprises a plurality of said wall members configured about, and extending from a perimeter of said striking surface.

6. The system of claim 5, wherein an orientation of each of said wall members is individually configurable.

7. The system of claim 6, wherein each of said wall members is operable to be slidably adjustable in a plane substantially perpendicular to the average plane defined by said striking surface.

8. The system of claim 1, wherein said return mechanism is a variable-resistance pneumatic spring system.

9. The system of claim 8, wherein said variable-resistance pneumatic spring system is capable of providing a variable resistance force that opposes the force of a strike delivered by said practitioner.

10. The system of claim 8, wherein said pneumatic spring system is a storm door closing assembly.

11. The system of claim 8, wherein said support arm and said base member each further comprise an attachment member configured to receive a portion of an elastic band configured to provide selectable pivot resistance of said support arm within said striking plane.

12. The system of claim 8, further comprising one or more stop members configured to prevent said support arm from pivoting beyond a pre-determined angle with respect to said base support member.

13. The system of claim 12, wherein said stop member is a flexible strap coupled at a proximal end to said base support member and coupled at a distal end to said support arm.

14. The system of claim 1, further comprising a mountable arm member configured to be positionable proximal to said striking surface having a distal end portion that defines a contact surface for said body part of said practitioner and substantially defines a starting position of said predetermined strike path.

15. The system of claim 1, wherein said attachment mechanisms allow adjustable positioning of said base member on said mounting assembly.

16. A system for practicing strikes, comprising:

a base member configured to be reversibly coupled to a mounting framework having a plurality of crossed arm members;

a rotatable platform sharing a common axis of rotation with said base member for supporting a striking assembly, wherein said striking assembly comprises:

a hingedly rotatable arm member having proximal and distal end portions, wherein said proximal end portion is hingedly coupled to said rotatable platform and said distal end is coupled to a striking surface member configured to receive a strike from a practitioner in a first position and travel in an arcuate path thereby to a second position;

one or more resistance means coupled to said rotatable arm member for providing variable resistance to the force of said strike upon said striking surface member moving from said first position to said second position, wherein said resistance means is capable of returning said striking surface member from said second position to said first position and not substantially therebeyond;

wherein said striking surface member comprises one or more wall members disposed about the perimeter of said striking surface member and extending substantially orthogonally from the surface thereof for the purpose of defining a striking surface strike zone exclusive of said wall members, wherein said wall members are capable of eliciting a tactile response in said practitioner if said practitioner contacts said wall members during the delivery of said strikes.

* * * * *